US006612421B1

(12) United States Patent
Köhl et al.

(10) Patent No.: US 6,612,421 B1
(45) Date of Patent: Sep. 2, 2003

(54) DEVICE FOR LOADING A FRAGMENTING MACHINE FOR EXAMPLE A HAMMER CRUSHER

(75) Inventors: Erich Köhl, Meerbusch (DE); Wilhelm Lindfeld, Düsseldorf (DE)

(73) Assignee: Metso Lindemann GmbH, Dusseldorf (DE)

( * ) Notice: Subject to any disclaimer, the term of this patent is extended or adjusted under 35 U.S.C. 154(b) by 0 days.

(21) Appl. No.: 10/129,346

(22) PCT Filed: Oct. 19, 2000

(86) PCT No.: PCT/DE00/03722

§ 371 (c)(1),
(2), (4) Date: Jul. 23, 2002

(87) PCT Pub. No.: WO01/32313

PCT Pub. Date: May 10, 2001

(30) Foreign Application Priority Data

Nov. 3, 1999 (DE) ..... 199 53 452

(51) Int. Cl.[7] ..... B02C 13/286; B03B 9/06
(52) U.S. Cl. ..... 198/624; 198/722
(58) Field of Search ..... 198/624, 722

(56) References Cited

U.S. PATENT DOCUMENTS 3,068,918 A * 12/1962 Smith ..... 198/624
3,587,985 A * 6/1971 Eidal ..... 241/138
4,750,853 A * 6/1988 Van Soest et al. ..... 414/43
4,907,632 A * 3/1990 Reuter ..... 198/624
5,762,332 A * 6/1998 Haroutel et al. ..... 198/624
6,216,756 B1 * 4/2001 Mason ..... 198/592
6,283,353 B1 * 9/2001 Gilbert ..... 226/190
6,409,462 B2 * 6/2002 Newsome et al. ..... 198/624

FOREIGN PATENT DOCUMENTS

| | | | |
|---|---|---|---|
| DE | 197 08 185 | 9/1998 | |
| FR | 2 660 213 | 10/1991 | |
| FR | 2 670 133 | 6/1992 | |
| JP | 1-209237 | * 8/1989 | ..... 198/624 |

* cited by examiner

*Primary Examiner*—Douglas Hess
(74) *Attorney, Agent, or Firm*—Norris McLaughlin & Marcus, P.A.

(57) ABSTRACT

The invention relates to a device for loading a fragmenting machine, such as a hammer crusher, including a front and rear upper drive roller which are equipped, independently of each other, with a drive mechanism and arranged above the feed plane of a feed chute. The drive rollers are mounted on a displaceable and pressure exerting system of levers, such that a continuous, pre-pressed and controlled feed of recyclable material for fragmenting is guaranteed.

11 Claims, 2 Drawing Sheets

DEVICE FOR LOADING A FRAGMENTING MACHINE FOR EXAMPLE A HAMMER CRUSHER

BACKGROUND OF THE INVENTION

1. Field of the Invention

Figure 1:
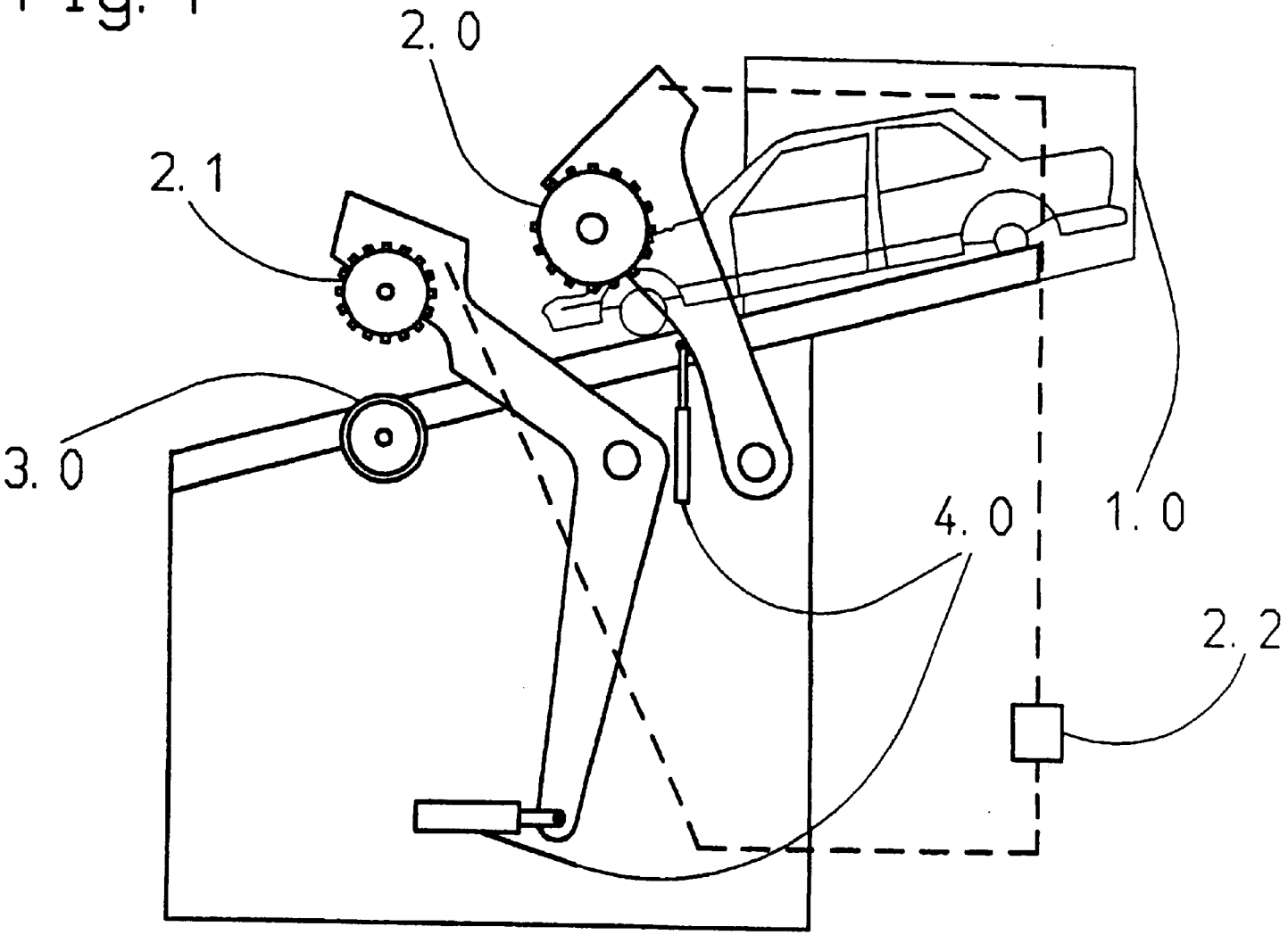

The invention relates to a device for loading a fragmenting machine, for example, a hammer crusher, which includes several rollers supported in a frame of the machine for feeding recyclable, preferably different types of metallic scrap material, such as bodies of discarded passenger vehicles and/or bundled scrap metal.

2. Description of the Related Art

SUMMARY OF THE INVENTION

Such devices are known from DE 197 08 185 A1 and include an upper drive roller and a lower roller. A press cover is connected to the upper drive roller which pre-presses the metallic scrap material before the pre-pressed scrap material is captured by the lower drive roller. This operative connection between the press cover and the top or drive roller has disadvantages. On one hand, the upper drive roller is difficult to handle and, on the other hand, is lifted during the pressing process as a result of the established connection with the press cover. As a result, the scrap material passing over the upper drive roller can reach the fragmenting machine in an uncontrolled manner. It is therefore difficult to meter the quantities loaded into the fragmenting machine.

Although other conventional systems, such as draw-in chains, press the material better than a single upper drive roller, they hold the material along their entire length. Disadvantageously, an arrangement with dual upper rollers with a common drive located in a frame has not only an increased mass compared to a single roller, but the dual upper rollers, once they are lifted, immediately release the scrap material, which defeats their intended function.

DESCRIPTION OF THE INVENTION

It is therefore an object of the invention to obviate these disadvantages so as to feed the scrap material in a continuous, pre-pressed and controllable manner, which can be easily managed. The present invention proposes to provide both a front upper drive roller and a rear upper drive roller, which have independent drives adapted to drive the drive rollers with identical or with only slightly different peripheral velocities. The drive rollers can rotate both forward and backward. The rear drive roller can be moved in an upward and downward direction over a certain range independent of the front drive roller. After the rear drive roller has been raised by a certain distance, the front drive roller is automatically raised and thereby "dances" on the material. The height of the front and rear drive rollers can be independently adjusted. The front drive roller can optionally be held in any suitable position. The front drive roller has a predetermined unobstructed passage relative to the feed plane. The rear drive roller then drops into a lower position. The downward motion of the front drive roller is interrupted when a minimum distance to the rear drive is reached. The rear drive roller can initiate additional pressing operations induced by hydraulic cylinders. The front drive roller is constructed so that it can also induce a pressing operation. Both pressing operations can be induced independent of each other. With this arrangement, even bulky scrap material can be controllably fed through manual or automatic control.

The invention can also be employed with systems that lack a lower roller in the feed device. The invention will now be described with reference to an embodiment illustrated in the drawings.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

The schematic drawings show in

Figure 2:
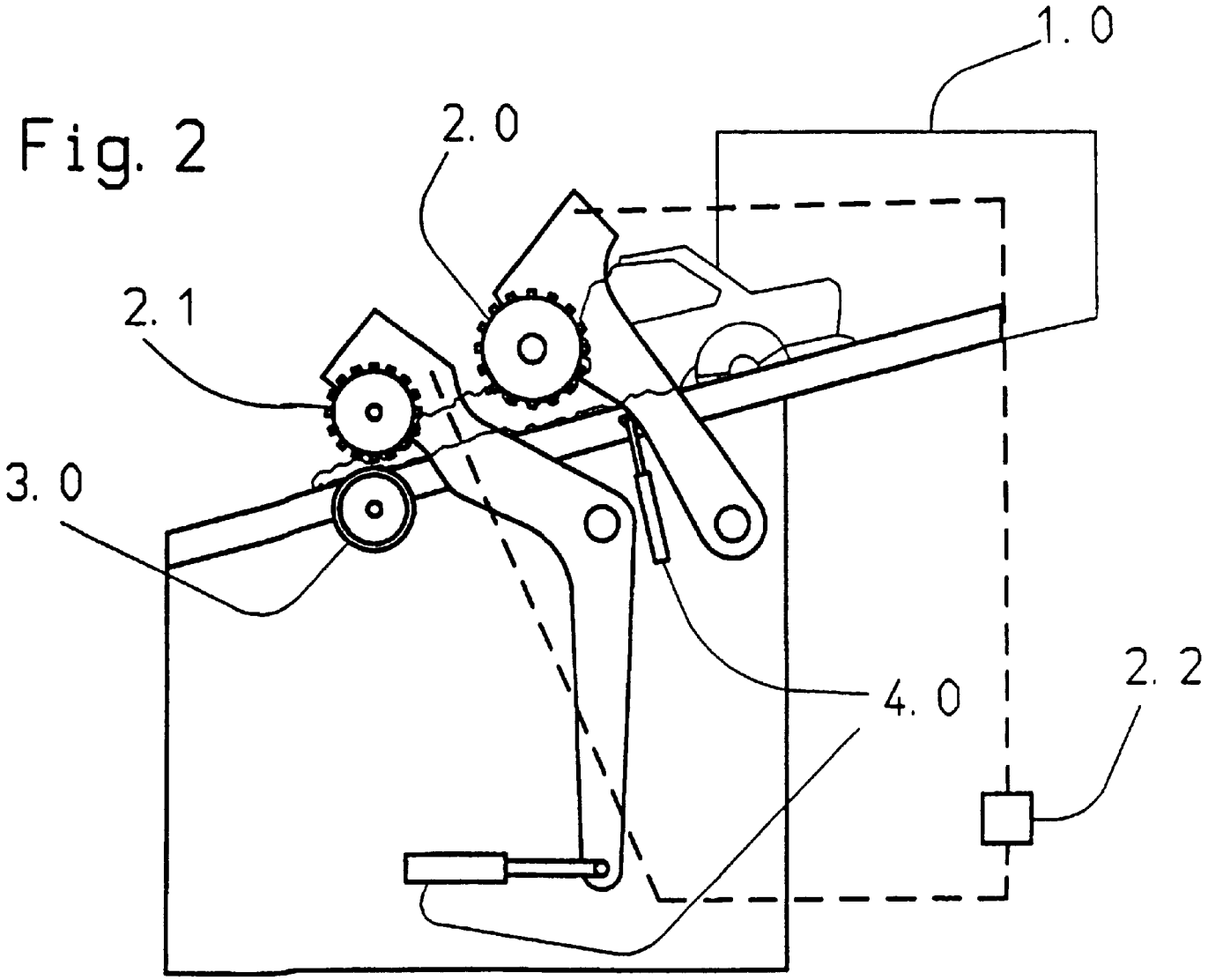

FIG. 1 a side view of the device of the invention at the start of the operative engagement of the front drive roller; and FIG. 2 the device of FIG. 1 in operative engagement between front and rear drive roller while drawing in metallic scrap material.

DETAILED DESCRIPTION OF THE PRESENTLY PREFERRED EMBODIMENTS

FIGS. 1 and 2 show a device for loading a fragmenting machine, such as a hammer crusher, which device is placed in front of the fragmenting machine (not shown).

The device includes essentially a feed chute 1.0 disposed on a frame (no reference numeral), with the feed chute being implemented as an inclined feed plane for the metallic scrap material, such as the body of a discarded passenger car. A front upper drive roller 2.0 is supported above the feed plane in a single-arm lever system (no reference numeral), with the drive roller 2.0 having its own drive (not shown). A rear upper drive roller 2.1 which is supported above the feed plane in a dual-arm articulated lever system and has its own drive (not shown), is arranged following the feed device for the scrap material. A lower roller 3.0, which breaks through the feed plane and operates as a sliding roller, is located in the feed plane below the rear upper drive roller 2.1 and is also supported in the frame.

The lever systems, which do not have reference numerals, are pivotally supported in the frame of the feed device at their respective pivot points and are connected to hydraulic cylinders 4.0 which are also supported on the frame. The hydraulic cylinders 4.0 initially operate independently, but can also cooperate so that the lever systems can be pivoted and also displaced relative to the feed plane, thereby causing the drive rollers 2.0, 2.1 to apply pressure to the scrap material.

The independent drives for the drive rollers 2.0 and 2.1 are controlled so that the drive rollers 2.0, 2.1 can rotate both forward and backward either with identical or with different peripheral velocities.

According to FIG. 1, metallic scrap material in the form of a body of a discarded passenger car is placed on the feed chute 1.0, the upper drive roller 2.0 is held in a position which allows the scrap material to pass unhindered to the feed plane. The upper drive roller 2.0 captures the scrap material and draws the scrap material in. The rear drive roller 2.1 assumes a comparable position so as to transport the scrap material onward on the feed plane by sliding it across the roller 3.0, as shown in FIG. 2. The lever systems that are operated by the hydraulic cylinders 4.0 can adjust the position of the drive rollers 2.0, 2.1 relative to the feed plane and move the drive rollers 2.0, 2.1 to apply pressure, so that the scrap material is continuously compacted to a desired or optimum thickness and loaded into the fragmenting machine in a controlled manner.

The downward motion of the front drive roller 2.0 is interrupted when the front drive roller 2.0 reaches a minimum distance with respect to the lower a drive roller 2.1, which guarantees that the scrap material is uniformly compacted. The rear and front drive rollers 2.0, 2.1 also initiate additional pressing operations for the scrap material, whereby the pressing operations can be carried out independently of one another. In all, the lever systems and the kinematically controllable drive rollers 2.0, 2.1 operate on the scrap material in a flexible, variable and/or optimum manner, so that the scrap material can be controllably and continuously loaded into the fragmenting machine as desired.

A control center 2.2 adapted to control the aforedescribed process flow either manually or automatically is provided to support the entire operation.

INDUSTRIAL APPLICABILITY

For continuously and controllably loading pre-pressed scrap materials of the above-defined type into a fragmenting machine, the conventional loading devices are improved so that the connected fragmenting machine can operate with optimum efficiency.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

LIST OF REFERENCE NUMERALS

1.0=feed chute
2.0=front upper drive roller
2.1=rear upper drive roller
2.2=control center
3.0=lower roller
4.0=hydraulic cylinder

What is claimed is:

1. A device for loading a fragmenting machine, comprising a plurality of rollers supported in a frame of the device for feeding recyclable materials, wherein at least an upper drive roller is supported in a moveable lever system, and comprising a) at least one front upper drive roller and one rear upper drive roller (2.0, 2.1) which independently from each other are provided with corresponding drives, are arranged above a feed plane of a feed chute (1.0), b) wherein the support of the front drive roller (2.0) is a single-arm lever system, is coupled to the frame and c) wherein the support of the rear drive roller (2.1) is a dual-arm lever system and coupled to the frame at a knee of the dual-arm lever system, d) positions of the drive rollers (2.0, 2.1) are capable of being adjusted relative to a feed plane and are operated by the lever systems, and e) drive elements are connected with the lever systems and supported on the frame for producing both the different relative positions of the drive rollers (2.0, 2.1) relative to the feed plane and for exerting the pressing forces applied by the drive rollers to the recyclable materials.

2. The device according to claim 1, wherein the drive rollers (2.0, 2.1) are uniformly driven.

3. The device according to claim 1, wherein the drive rollers (2.0, 2.1) are driven with mutually different peripheral velocities.

4. The device according to claim 3, wherein the recyclable material comprises vehicle bodies.

5. The device according to claim 3, wherein the recyclable material comprises bundled scrap metal.

6. The device according to claim 1, wherein the drive rollers (2.0, 2.1) are driven so as to rotate forward and backward, i.e. reversibly.

7. The device according to claim 1, wherein the drive elements for the lever systems that are supported on the frame are hydraulic cylinders (4.0).

8. The device according to claim 1 wherein means for a manual control of the process flow via a control center (2.2) are utilized.

9. The device according to claim 1, wherein means for an automatic control of the process flow via a control center (2.2) are utilized.

10. The device according to claim 1, wherein the fragmenting machine is a hammer crusher.

11. The device according to claim 1, wherein the recyclable material is metallic scrap material.

* * * * *

UNITED STATES PATENT AND TRADEMARK OFFICE

CERTIFICATE OF CORRECTION

PATENT NO. : 6,612,421 B1
DATED : September 2, 2003
INVENTOR(S) : Erich Kohl and Wilhelm Lindfeld It is certified that error appears in the above-identified patent and that said Letters Patent is hereby corrected as shown below:

Column 1,
Line 15, please delete the line reading:
"SUMMARY OF THE INVENTION"
Line 38, please replace the line reading:
"DESCRIPTION OF THE INVENTION" with -- SUMMARY OF THE INVENTION --

Column 2,
Below line 11, please insert the following line:
-- BRIEF DESCRIPTIONS OF THE DRAWINGS --

Signed and Sealed this

Twenty-third Day of December, 2003

JAMES E. ROGAN
*Director of the United States Patent and Trademark Office*